US010189674B2

(12) United States Patent
Ogata et al.

(10) Patent No.: US 10,189,674 B2
(45) Date of Patent: Jan. 29, 2019

(54) IMAGE FORMING APPARATUS

(71) Applicant: CANON KABUSHIKI KAISHA, Tokyo (JP)

(72) Inventors: Atsushi Ogata, Mishima (JP); Kazushi Ino, Suntou-gun (JP); Hiroki Kato, Gotemba (JP); Motohiro Furusawa, Shizuoka (JP); Koji Kawamura, Yokohama (JP); Ichiro Yasumaru, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 29 days.

(21) Appl. No.: 15/472,514

(22) Filed: Mar. 29, 2017

(65) Prior Publication Data

US 2017/0305712 A1 Oct. 26, 2017

(30) Foreign Application Priority Data

Apr. 21, 2016 (JP) ..... 2016-085611

(51) Int. Cl.
*B65H 85/00* (2006.01)
*B65H 29/12* (2006.01)
(Continued)

(52) U.S. Cl.
CPC ..... *B65H 85/00* (2013.01); *B65H 29/12* (2013.01); *B65H 29/58* (2013.01); *B65H 43/00* (2013.01);
(Continued)

(58) Field of Classification Search
CPC ..... B65H 85/00
(Continued)

(56) References Cited

U.S. PATENT DOCUMENTS 6,302,606 B1 10/2001 Hayakawa et al.
6,318,718 B1 11/2001 Ogata et al.
(Continued)

FOREIGN PATENT DOCUMENTS

JP 2006-232467 A 9/2006
JP 2013-003448 A 1/2013

OTHER PUBLICATIONS

Copending, unpublished, U.S. Appl. No. 15/472,507, to Atsushi Ogata, filed Mar. 29, 2017.

*Primary Examiner* — Anthony Nguyen
(74) *Attorney, Agent, or Firm* — Venable LLP

(57) ABSTRACT

An image forming apparatus including an image forming unit, first and second discharging portions, first and second supporting portions, an image reading portion, and first and second switching portions is provided. The first switching portion switches between causing a sheet bearing an image formed by the image forming unit to be discharged to the first supporting portion by the first discharging portion and causing the sheet to be conveyed toward the image reading portion that reads the image. The second switching portion switches between causing the sheet whose image has been read to be conveyed toward the second discharging portion that discharges the sheet whose image has been read to the second supporting portion and causing the sheet to be conveyed toward the image forming unit. The image reading portion is disposed above the first discharging portion and further on the inside of the apparatus than the second switching portion.

11 Claims, 11 Drawing Sheets

(51) Int. Cl.
*B65H 43/00* (2006.01)
*G03G 15/00* (2006.01)
*B65H 29/58* (2006.01)

(52) U.S. Cl.
CPC ... *G03G 15/6529* (2013.01); *B65H 2301/132* (2013.01); *B65H 2301/1321* (2013.01); *B65H 2301/33312* (2013.01); *B65H 2404/632* (2013.01); *B65H 2404/693* (2013.01); *B65H 2405/3321* (2013.01); *B65H 2801/06* (2013.01); *B65H 2801/39* (2013.01)

(58) Field of Classification Search
USPC ..... 399/405
See application file for complete search history.

(56) References Cited

U.S. PATENT DOCUMENTS 6,325,371 B1 12/2001 Araki et al.
6,382,614 B1 5/2002 Fukatsu et al.
6,690,901 B2 * 2/2004 Katsuyama ..... G03G 15/6552 399/107
6,731,903 B2 * 5/2004 Suzuki ..... G03G 15/6552 271/279
6,826,374 B2 11/2004 Kato et al.
6,973,285 B2 12/2005 Sekiyama et al.
6,997,449 B2 2/2006 Obuchi et al.
8,061,712 B2 11/2011 Tsuji et al.
8,382,109 B2 2/2013 Tsuji et al.
8,690,150 B2 4/2014 Obara et al.
8,720,886 B2 5/2014 Kuroda et al.
8,870,182 B2 10/2014 Ogata et al.
8,964,271 B2 2/2015 Kaneko et al.
9,071,712 B2 6/2015 Ino et al.
9,071,713 B2 6/2015 Ogata et al.
9,137,403 B2 9/2015 Ogata et al.
9,203,994 B2 12/2015 Kato et al.
9,395,672 B2 7/2016 Kaneko et al.
9,521,282 B2 12/2016 Kato et al.
2009/0324263 A1 * 12/2009 Shimizu ..... B65H 1/04 399/38
2013/0293909 A1 11/2013 Endo et al.
2014/0151954 A1 6/2014 Furusawa et al.
2014/0321897 A1 10/2014 Ogata et al.
2015/0069694 A1 * 3/2015 Taki ..... B65H 7/20 271/3.19

* cited by examiner

IMAGE FORMING APPARATUS

BACKGROUND OF THE INVENTION

Field of the Invention

The present invention relates to an image forming apparatus including an image reading portion.

Description of the Related Art

Regarding an image forming apparatus such as a copier or a multifunctional printer, i.e. an MFP, an automatic document feeder, i.e. an ADF, disposed in an upper portion of an image forming apparatus body and an image forming apparatus capable of performing feeding-reading of documents by using the ADF are known. The image forming apparatus body will be hereinafter referred to as an apparatus body. This image forming apparatus is configured such that image formation processing on a sheet serving as a recording medium and image reading processing from a sheet of a document are both realized. Such an image forming apparatus including an image reading portion typically includes an exclusive conveyance path for a recording medium in an image forming portion and an exclusive conveyance path for a document in the image reading portion, and is configured such that the document and the recording medium cannot get into the conveyance path of one another.

Regarding this, Japanese Patent Laid-Open No. 2006-232467 proposes an image forming apparatus including an image reading unit in a duplex conveyance path in an apparatus body such that a conveyance path for a recording medium is shared as a conveyance path for a document.

In addition, Japanese Patent Laid-Open No. 2013-3448 proposes an image forming apparatus that employs a configuration in which a feed portion and a discharging portion are shared for a recording medium and a document, and the recording medium on which an image has been formed is discharged after passing through an image reading portion. This image forming apparatus includes a common path that is shared as a part of a conveyance path for a recording medium and a part of a conveyance path for a document, and thus is capable of reading an image on the recording medium by sending the recording medium on which the image has been printed by an image forming portion to the image reading portion. According to this, it is possible to check whether image formation processing has been properly performed by the image forming portion and to store a printed image formed on the recording medium as new image information.

The image can be read by providing an image reading portion such that a sheet can be conveyed from an image forming portion to the image reading portion and from the image reading portion to the image forming portion as in a conventional technique. However, the apparatus body may be larger depending on the position at which the image reading portion is disposed.

SUMMARY OF THE INVENTION

According to an aspect of the present invention, an image forming apparatus including an image forming unit, a first discharging portion, a first supporting portion, an image reading portion, a first switching portion, a second discharging portion, a second supporting portion, and a second switching portion is provided. The image forming unit is configured to form an image on a sheet. The first discharging portion is configured to discharge the sheet on which the image has been formed to an outside of the image forming apparatus. The first supporting portion is configured to support the sheet discharged by the first discharging portion. The image reading portion is configured to read the image formed on the sheet. The first switching portion is configured to switch between a first position to cause the sheet discharged by the first discharging portion to be conveyed to the first supporting portion and a second position to cause the sheet to be conveyed toward the image reading portion configured to read the image. The second discharging portion is configured to discharge the sheet whose image has been read by the image reading portion to the outside of the image forming apparatus. The second supporting portion is configured to support the sheet discharged by the second discharging portion. The second switching portion is configured to switch between a third position to cause the sheet whose image has been read by the image reading portion to be conveyed toward the second discharging portion and a fourth position to cause the sheet to be conveyed toward the image forming unit. The image reading portion is disposed above the first discharging portion in a vertical direction and further on an inside of the image forming apparatus than the second switching portion in a direction perpendicular to the vertical direction.

According to another aspect of the present invention, an image forming apparatus including an image forming unit, a first discharging portion, a first supporting portion, an image reading portion, a first switching portion, a second discharging portion, a second supporting portion, and a second switching portion is provided. The image forming unit is configured to form an image on a sheet. The first discharging portion is configured to discharge the sheet on which the image has been formed to an outside of the image forming apparatus. The first supporting portion is configured to support the sheet discharged by the first discharging portion. The image reading portion is configured to read the image formed on the sheet. The first switching portion is configured to switch between a first position to cause the sheet on which the image has been formed by the image forming unit to be conveyed toward the first discharging portion and a second position to cause the sheet to be conveyed toward the image reading portion configured to read the image. The second discharging portion is configured to discharge the sheet whose image has been read by the image reading portion to the outside of the image forming apparatus. The second supporting portion is configured to support the sheet discharged by the second discharging portion. The second switching portion is configured to switch between a third position to cause the sheet whose image has been read by the image reading portion to be conveyed toward the second discharging portion and a fourth position to cause the sheet to be conveyed toward the image forming unit. The image reading portion is disposed above the first discharging portion in a vertical direction and further on an inside of the image forming apparatus than the second switching portion in a direction perpendicular to the vertical direction.

According to yet another aspect of the present invention, an image forming apparatus including an image forming unit, a first discharging portion, a first supporting portion, an image reading portion, a first switching portion, a second discharging portion, a second supporting portion, and a second switching portion is provided. The image forming unit is configured to form an image on a sheet. The first discharging portion is configured to discharge the sheet on which the image has been formed to an outside of the image forming apparatus or invert and convey the sheet back into the image forming apparatus. The image reading portion is configured to read the image formed on the sheet. The first switching portion is configured to switch between a first position to cause the sheet inverted by the first discharging portion to be conveyed toward the image forming unit and a second position to cause the sheet to be conveyed toward the image reading portion configured to read the image. The second discharging portion is configured to discharge the sheet whose image has been read by the image reading portion to the outside of the image forming apparatus or invert and convey the sheet back into the image forming apparatus. The second supporting portion is configured to support the sheet discharged by the second discharging portion. The second switching portion is configured to switch between a third position to cause the sheet inverted by the second discharging portion to be conveyed toward the image forming unit and a fourth position to cause the sheet to be conveyed toward the image reading portion. The image reading portion is disposed above the first discharging portion in a vertical direction and further on an inside of the image forming apparatus than the second switching portion in a direction perpendicular to the vertical direction.

Further features of the present invention will become apparent from the following description of exemplary embodiments with reference to the attached drawings.

DESCRIPTION OF THE EMBODIMENTS

First Exemplary Embodiment

Figure 1:
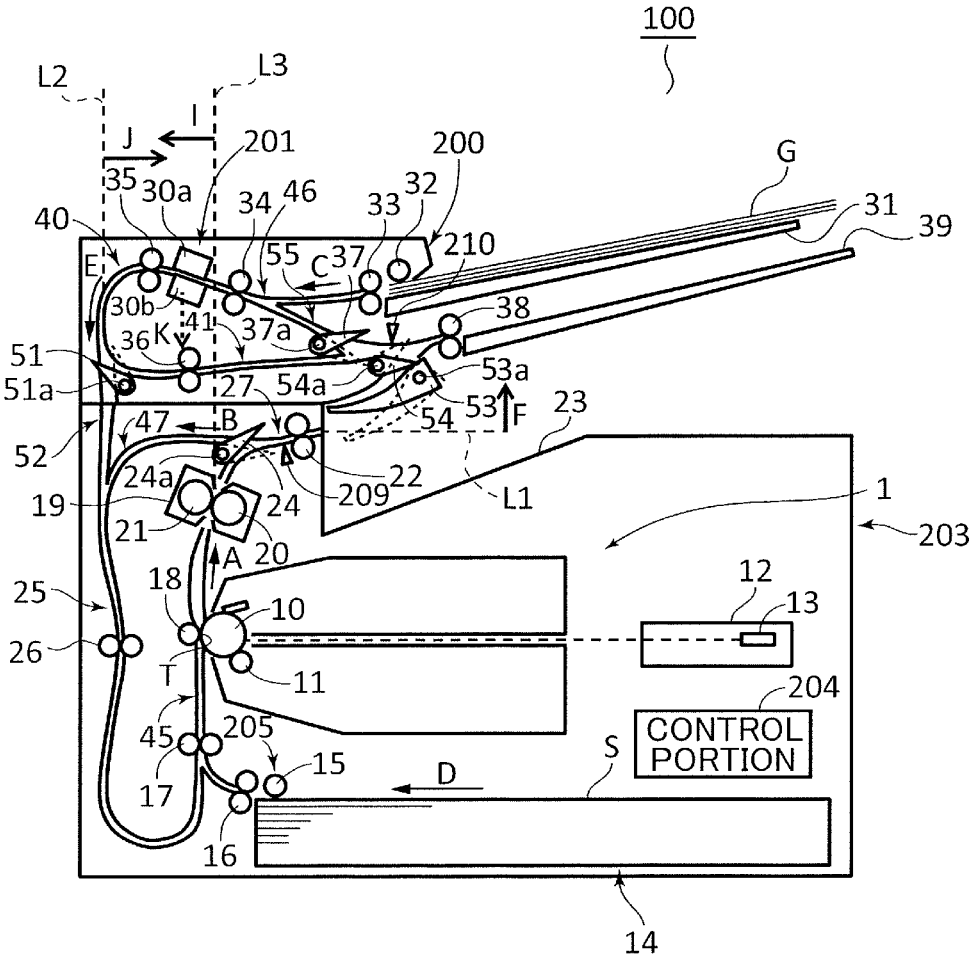
FIG. 1 is a schematic section view of an image forming apparatus including an image reading portion according to a first exemplary embodiment of the present invention.
Figure 2:
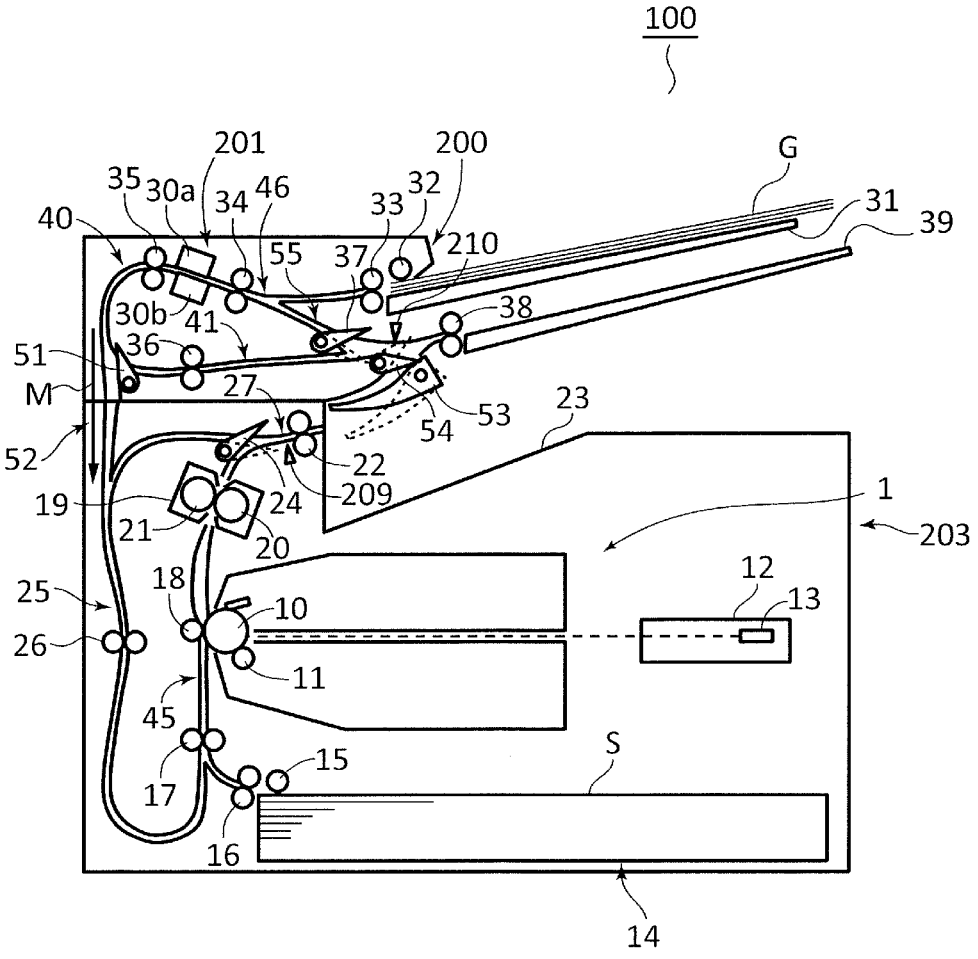
FIG. 2 illustrates an operation of the image forming apparatus according to the first exemplary embodiment.

FIG. 1 is a schematic section view of an image forming apparatus equipped with an image reading apparatus according to a first exemplary embodiment of the present invention. In the present exemplary embodiment, an aspect of the present invention is realized by an apparatus including a laser-beam printer of an electrophotographic system and an image scanner of a sheet-through type. However, the present invention is not limited to this embodiment and is widely applicable to image forming apparatuses employing other systems. In the description that will be given below, a sheet fed from a first feed portion 14 and a sheet fed from a second feed portion 31 will be respectively referred to as, for example, a recording medium S and a document G. However, both of the recording medium S and the document C may be simply referred to as a sheet. That is, in the description below, each of the recording medium S and the document G may be replaced by a word "sheet".

Image Forming Apparatus

First, an overall configuration of an image forming apparatus 100 according to the present exemplary embodiment will be described with reference to FIG. 1. FIG. 1 is a schematic section view of the image forming apparatus 100 according to the present exemplary embodiment.

As illustrated in FIG. 1, the image forming apparatus 100 includes an image forming portion 203 capable of forming an image and an image reading portion 200 disposed above the image forming portion 203. The image forming portion 203 includes a sheet feed portion 205 configured to feed a recording medium S and a control portion 204 configured to control the image forming portion 203, the image reading portion 200, and so forth.

Image Forming Portion

A first feed portion 14 supports a recording medium S. A feed roller 15 feeds the recording medium S supported by the first feed portion 14. A separation conveyance roller pair 16 separates recording media S such that the recording medium S fed by the feed roller 15 is conveyed one by one. The first feed portion 14 and the feed roller 15 may be also collectively called as the sheet feed portion 205. A registration roller pair 17 conveys the recording medium S separated and conveyed by the separation conveyance roller pair 16 to a transfer portion T at a timing matching transfer of a toner image formed on a surface of a photosensitive drum 10. A conveyance path through which the recording medium S is conveyed from the registration roller pair 17 to the transfer portion T is called as an image formation conveyance path 45 serving as a first conveyance path.

The photosensitive drum 10 is a rotatable image bearing member on which a toner image is to be formed. An optical unit 12 includes a light emitting portion 13 and forms an electrostatic latent image on the photosensitive drum 10. The light emitting portion 13 irradiates the photosensitive drum 10 with laser light. A developing roller 11 develops the electrostatic latent image formed on the photosensitive drum 10 as a toner image. A transfer roller 18 transfers the toner image formed on the photosensitive drum 10 onto the recording medium S. The photosensitive drum 10, the optical unit 12, and the developing roller 11 may be also collectively called as an image forming unit 1. The transfer portion T is constituted by the photosensitive drum 10 and the transfer roller 18.

A fixing portion 19 includes a heating portion 20 and a pressurizing roller 21, and fixes the unfixed toner image transferred from the photosensitive drum 10 onto the recording medium S. The heating portion 20 heats the recording medium S, and the pressurizing roller 21 pressurizes the recording medium S. A sheet detection sensor 209 detects a conveyance state of the recording medium S being conveyed in a discharge conveyance path 27. A discharge roller pair 22 serving as a first discharging portion discharges the recording medium S onto which an image has been fixed by the fixing portion 19 from the image forming portion 203. A first sheet discharged portion 23 serving as a first supporting portion supports the recording medium S discharged by the discharge roller pair 22. The rotation direction of the discharge roller pair 22 can be switched between a normal rotation direction and a reverse rotation direction by a switching mechanism that is not illustrated. The discharge roller pair 22 is capable of inverting the recording medium S and conveying the recording medium S back into the image forming portion 203 in an arrow B direction by switching the rotation direction before the recording medium S is completely discharged. In addition, it can be also said that the discharge roller pair 22 also serves as an inversion re-conveyance portion that inverts the recording medium S and conveys the recording medium S again to the image forming portion 203 so as to form an image on a lower surface of the recording medium S on an upper surface of which an image has been already formed by the image forming portion 203. The upper surface and the lower surface will be also respectively referred to as a first surface and a second surface. The inversion is performed such that a leading end and a trailing end of the recording medium S are interchanged. A conveyance path through which the recording medium S is conveyed from the transfer portion T to the discharge roller pair 22 is called as the discharge conveyance path 27.

A duplex inversion switching member 24 is disposed between the fixing portion 19 and the discharge roller pair 22, and switches between guiding the recording medium S onto which an image has been fixed by the fixing portion 19 to be conveyed to the discharge roller pair 22 and guiding the recording medium S inverted by the discharge roller pair 22 to be conveyed to a duplex conveyance path 25. The duplex inversion switching member 24 is supported so as to be pivotable between a solid line position and a broken line position about a pivot shaft 24*a*. The solid line position illustrated by solid lines in FIG. 1 is set as an initial position, and the position of the duplex inversion switching member 24 is switched to the broken line position illustrated by broken lines as a result of being driven by a first solenoid SL1 illustrated in FIG. 8 that is an actuator. Alternatively, the duplex inversion switching member 24 may be configured such that the broken line position illustrated in FIG. 1 is set as the initial position, and that the duplex inversion switching member 24 is urged in a clockwise direction by a spring or the like that is not illustrated and pivots to the solid line position as a result of being pushed open by a leading end of the recording medium S that has reached the duplex inversion switching member 24. In a state where the duplex inversion switching member 24 is at the solid line position, the duplex inversion switching member 24 guides the recording medium S onto which an image has been fixed by the fixing portion 19 to be conveyed to the discharge roller pair 22. In a state where the duplex inversion switching member 24 is at the broken line position, the duplex inversion switching member 24 guides the recording medium S inverted by the discharge roller pair 22 to be conveyed to the duplex conveyance path 25. The inverted recording medium S is conveyed through a re-conveyance path 47 and the duplex conveyance path 25. A duplex conveyance roller pair 26 conveys the recording medium S again to the registration roller pair 17 from the duplex conveyance path 25. Then, an image is formed on the second surface of the recording medium S. The duplex conveyance path 25 constitutes a second conveyance path capable of guiding a document G or the like whose image has been read by an image reading section 201 toward the image forming unit 1. Through the re-conveyance path 47, the recording medium S inverted by the discharge roller pair 22 can be conveyed again to the image forming unit 1.

Image Reading Portion

A second feed portion 31 serving as a sheet supplying portion supports a document G. A feed roller 32 feeds the document G supported by the second feed portion 31. A separation conveyance roller pair 33 separates documents G such that the document G fed by the feed roller 32 is conveyed one by one. A conveyance roller pair 34 conveys the document G separated and conveyed by the separation conveyance roller pair 33 to the image reading section 201. A conveyance path through which the document G is conveyed from the second feed portion 31 to the image reading section 201 is called as a reading guide path 46 serving as a conveyance route. The image reading section 201 includes an image reading unit 30*a* and an image reading unit 30*b* disposed so as to oppose each other with a conveyance path through which the document G is conveyed interposed therebetween. The image reading unit 30*a* reads an image on an upper surface of the document G, and the image reading unit 30*b* reads an image on a lower surface of the document G. The upper surface and the lower surface will be also respectively referred to as a first surface and a second surface. The image reading section 201 including these components reads an image formed on the document G. Although a configuration in which two image reading units are provided will be described as an example, a configuration in which only one of these image reading units is provided may be employed. The image reading units 30*a* and 30*b* each serving as an image reading portion respectively include contact image sensors: CISs 208*a* and 208*b*.

A conveyance roller pair 35 conveys the document G in a document conveyance path 40. A conveyance roller pair 36 conveys the document G in a downstream document conveyance path serving as a sheet conveyance path. A sheet detection sensor 210 detects a conveyance state of the document G being conveyed in the downstream document conveyance path 41. A document discharge roller pair 38 serving as a second discharging portion discharges the document G from the image reading portion 200. The document G discharged by the document discharge roller pair 38 is supported by a second sheet discharged portion 39 serving as a second supporting portion. The rotation direction of the document discharge roller pair 38 can be switched between a normal rotation direction and a reverse rotation direction by a switching mechanism that is not illustrated. The document discharge roller pair 38 is capable of inverting the document G and conveying the document G back into the image reading portion 200 by switching the rotation direction before the document G is completely discharged.

A reading inversion switching member 37 is disposed between the conveyance roller pair 36 and the document discharge roller pair 38. The reading inversion switching member 37 switches between guiding the document G to be conveyed from the conveyance roller pair 36 to the document discharge roller pair 38 and guiding the document G inverted by the document discharge roller pair 38 to be conveyed again to the image reading section 201. The reading inversion switching member 37 is supported so as to be pivotable between a solid line position and a broken line position about a pivot shaft 37*a*. The solid line position illustrated in FIG. 1 is set as an initial position, and the position of the reading inversion switching member 37 is switched to the broken line position as a result of being driven by a second solenoid SL2 illustrated in FIG. 8 that is an actuator. Alternatively, the reading inversion switching member 37 may be configured such that the broken line position illustrated in FIG. 1 is set as the initial position, and that the reading inversion switching member 37 is urged in a clockwise direction and pivots to the solid line position as a result of being pushed open by a leading end of the document G that has been conveyed to the reading inversion switching member 37. In a state where the reading inversion switching member 37 is at the solid line position, the reading inversion switching member 37 guides the document G to be conveyed from the conveyance roller pair 36 to the document discharge roller pair 38. In a state where the reading inversion switching member 37 is at the broken line position, the reading inversion switching member 37 guides the document G inverted by the document discharge roller pair 38 to be conveyed again to the image reading section 201. The inverted document G is conveyed again to the conveyance roller pair 34 through a document inversion conveyance path 55.

Connection Between Image Forming Portion and Image Reading Portion

A recording medium reading switching member 53 serving as a first switching portion switches between guiding the recording medium S discharged by the discharge roller pair 22 to be discharged to the first sheet discharged portion 23 serving as a discharge route and guiding the recording medium S to be conveyed to the image reading portion 200. That is, the recording medium reading switching member 53*a* is configured to switch between a first position to cause the sheet discharged by the first discharging portion 22 to be conveyed to the first supporting portion 23 and a second position to cause the sheet to be conveyed toward the image reading portion 200 configured to read the image. The recording medium reading switching member 53 is disposed above the first sheet discharged portion 23 serving as a first supporting portion, and is supported so as to be pivotable between a solid line position and a broken line position about a pivot shaft 53*a*. The solid line position illustrated in FIG. 1 is set as an initial position, and the position of the recording medium reading switching member 53 is switched to the broken line position as a result of being driven by a fourth solenoid SL4 illustrated in FIG. 8 that is an actuator. In a state where the recording medium reading switching member 53 is at the solid line position, the recording medium reading switching member 53 guides the recording medium S to be discharged to the first sheet discharged portion 23. In a state where the recording medium reading switching member 53 is at the broken line position, the recording medium reading switching member 53 guides the recording medium S to be conveyed to the image reading portion 200.

A merge switching member 54 switches between accepting the recording medium S conveyed from the image forming unit 1 and guiding the recording medium S inverted by the document discharge roller pair 38 to be conveyed into the image reading portion 200. The merge switching member 54 is supported so as to be pivotable between a solid line position and a broken line position about a pivot shaft 54*a*. The solid line position illustrated in FIG. 1 is set as an initial position, and the position of the merge switching member 54 is switched to the broken line position as a result of being driven by a fifth solenoid SL5 illustrated in FIG. 8 that is an actuator. In a state where the merge switching member 54 is at the solid line position, the merge switching member 54 guides the recording medium S to be conveyed into the image reading portion 200. In a state where the merge switching member 54 is at the broken line position, the merge switching member accepts the recording medium S conveyed from the image forming unit 1.

An overwriting conveyance path 52 serving as a third conveyance path is a conveyance path that connects the document conveyance path 40 upstream thereof and the duplex conveyance path 25 so as to convey the document G from the document conveyance path 40 to the duplex conveyance path 25. An overwriting switching member 51 switches between guiding the document G whose image has been read by the image reading section 201 to be conveyed to the downstream document conveyance path 41 and guiding the document G to be conveyed to the overwriting conveyance path 52. The overwriting switching member 51 is supported so as to be pivotable between a solid line position and a broken line position about a pivot shaft 51*a*. That is, the overwriting switching member 51 serves as a second switching portion configured to switch between a third position to cause the sheet whose image has been read by the image reading portion 201 to be conveyed toward the second discharging portion 39 and a fourth position to cause the sheet to be conveyed toward the image forming unit 1. The solid line position illustrated in FIG. 1 is set as an initial position, and the position of the overwriting switching member 51 is switched to the broken line position as a result of being driven by a third solenoid SL3 illustrated in FIG. 8 that is an actuator. In a state where the overwriting switching member 51 is at the solid line position, the overwriting switching member guides the document G to be conveyed to the downstream document conveyance path 41. In a state where the overwriting switching member 51 is at the broken line position, the overwriting switching member 51 guides the document G to be conveyed to the overwriting conveyance path 52.

The image reading units 30*a* and 30*b* are disposed above the discharge roller pair 22 serving as a first discharging portion in the vertical direction and further on the inside of the apparatus than the overwriting switching member 51 serving as the second switching portion in a direction perpendicular to the vertical direction. In this way, the apparatus is configured such that the area for installation of the apparatus is not larger than the image forming unit 1.

Control System

Figure 8:
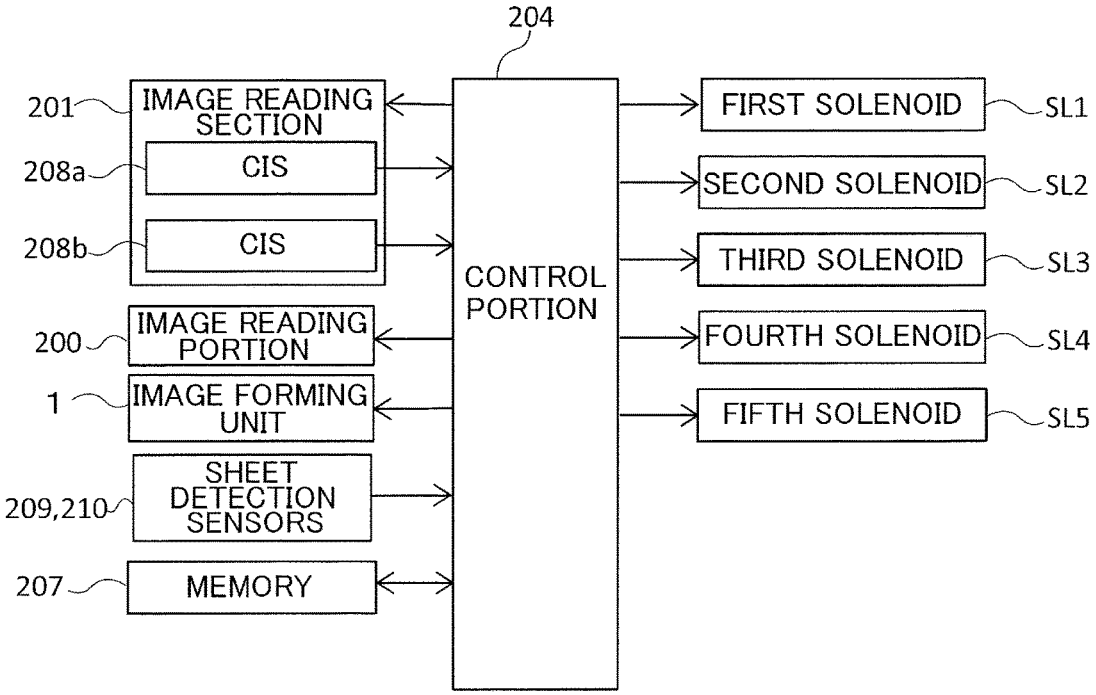
FIG. 8 is a control block diagram illustrating a control system of the image forming apparatus according to the first exemplary embodiment.

Next, a control system according to the present exemplary embodiment will be described with reference to FIG. 8. FIG. 8 is a control block diagram of a control system of the image forming apparatus 100 according to the present exemplary embodiment.

The control portion 204 illustrated in FIGS. 1 and 8 controls an image forming operation of the image forming portion 203, an image reading operation of the image reading portion 200, and so forth. The control portion 204 is connected to the image reading section 201 including the CISs 208*a* and 208*b*, the image reading portion 200, the image forming unit 1, and the sheet detection sensors 209 and 210. Further, the control portion 204 is connected to a memory 207, conveyance rollers in the image forming portion 203, and so forth. Document image information read by the CISs 208*a* and 208*b* is stored on the memory 207.

In addition, the control portion 204 is connected to the first to fifth solenoids SL1 to SL5. The first solenoid SL1 provides the drive for switching the duplex inversion switching member 24. The second solenoid SL2 provides the drive for switching the reading inversion switching member 37. The third solenoid SL3 provides the drive for switching the overwriting switching member 51. The fourth solenoid SL4 provides the drive for switching the recording medium reading switching member 53. The fifth solenoid SL5 provides the drive for switching the merge switching member 54.

Image Formation Process

Next, an image formation process in the image forming unit 1 will be described.

As illustrated in FIG. 1, the image forming unit 1 provided in the image forming apparatus 100 forms a toner image via a known electrophotographic image formation process. That is, the image forming unit 1 includes the photosensitive drum and the developing roller 11 disposed therein. The photosensitive drum 10 is rotatable and serves as an image bearing member. The developing roller 11 is disposed parallel to and in contact with the photosensitive drum 10, and rotates while bearing toner. In the case where a print signal, in other words, a print job signal, is received, the light emitting portion 13 included in the optical unit 12 irradiates the electrified surface of the photosensitive drum 10 with laser light, and thereby forms a latent image of charges on the surface of the rotating photosensitive drum 10. In the case where the developing roller 11 supplies toner to the latent image on the surface of the photosensitive drum 10 while rotating, a toner image is formed on the surface of the photosensitive drum 10.

The recording medium S set in the first feed portion 14 is conveyed one by one to the registration roller pair 17 by the feed roller 15 and the separation conveyance roller pair 16. The registration roller pair 17 conveys the recording medium S to the transfer portion T at such a timing that leading end positions of the toner image on the surface of the photosensitive drum 10 and the recording medium S match each other. The toner image conveyed to the transfer portion by the rotation of the photosensitive drum 10 is transferred onto the recording medium S by an application bias and a pressure applied to the transfer portion T.

Further, the recording medium S is conveyed to the fixing portion 19, and the toner image is fixed onto the recording medium S by the heat applied by the heating portion 20 and the pressure applied by the pressurizing roller 21 that is rotatable and opposes the heating portion 20. The recording medium S onto which the toner image has been fixed is conveyed to the discharge roller pair 22 through the discharge conveyance path 27.

In the case where the print signal is a signal for single-sided printing, the recording medium S that has been conveyed in an arrow A direction, has passed by the duplex inversion switching member 24, and has reached the discharge roller pair 22 is directly conveyed to the outside of the apparatus and discharged to the first sheet discharged portion 23 on the image forming portion 203 to be supported by the first sheet discharged portion 23. In this way, the image formation process of single-sided printing is completed.

In addition, in the case where the print signal is a signal for duplex printing, the following occurs after the recording medium S on the first surface of which printing has been completed is conveyed by the discharge roller pair 22 and the trailing end thereof passes by the duplex inversion switching member 24. That is, the position of the duplex inversion switching member 24 is switched to the broken line position by the first solenoid SL1 that is an actuator or by the urging force applied in the clockwise direction illustrated in FIG. 1, and the discharge roller pair 22 is caused to rotate in the reverse rotation direction by the switching portion that is not illustrated. The recording medium S conveyed in the reverse direction by the discharge roller pair 22 is guided to the duplex conveyance path 25 by the duplex inversion switching member 24 through the re-conveyance path 47. After that, the recording medium S is sent to the registration roller pair 17 in the image formation conveyance path 45 by the duplex conveyance roller pair 26. Then, the recording medium S is conveyed to the transfer portion T and the fixing portion 19 in an inverted state, and thus a toner image is transferred and fixed onto the second surface of the recording medium S. After that, the recording medium S is discharged to the first sheet discharged portion 23 by the discharge roller pair 22, and is supported by the first sheet discharged portion 23.

Image Reading Process

Next, an image reading process of the image reading portion 200 will be described with reference to FIG. 1.

In FIG. 1, the document G set on the second feed portion 31 is fed one by one by the feed roller 32 and the separation conveyance roller pair 33, and then is conveyed by the conveyance roller pair 34 through the reading guide path 46 and passes between the image reading units 30*a* and 30*b*. At this time, images on the upper surface and the lower surface of the document G are respectively read by the image reading units 30*a* and 30*b*. The document G that has passed between the image reading units 30*a* and 30*b* is conveyed to the document discharge roller pair 38 by the conveyance roller pairs 35 and 36 through the downstream document conveyance path 41. The document G passes by the reading inversion switching member 37 on the way to the document discharge roller pair 38. At this time, the reading inversion switching member 37 moves to the solid line position illustrated in FIG. 1 as a result of being opened by the second solenoid SL2 illustrated in FIG. 8 or being pushed open by the leading end of the document G. As a result of this, the document G that has reached the document discharge roller pair 38 is discharged to the second sheet discharged portion 39 by the document discharge roller pair 38 and is supported by the second sheet discharged portion 39.

Here, in the case where only one image reading unit is provided, this process may be performed as follows. For example, in the case where only the image reading unit 30*a* is provided in the apparatus, the rotation direction of the document discharge roller pair 38 is switched and the position of the reading inversion switching member 37 is switched to the broken line position after the upper surface of the document G is read and the trailing end of the document G passes by the reading inversion switching member 37. As a result of this, the document G is conveyed to the document inversion conveyance path 55 that is merged with the document conveyance path 40. In this way, the document G can pass by the image reading unit 30*a* after being inverted, and thus both surfaces of the document G can be read.

Process of Overwriting Printing on Document

Next, a process of overwriting printing on the document G will be described with reference to FIGS. 1 to 4.

In FIG. 1, the overwriting switching member 51 disposed in the document conveyance path 40 can be switched between the solid line position and the broken line position. At the solid line position, the document G conveyed through the document conveyance path 40 is sent to the document discharge roller pair 38 through the downstream document conveyance path 41. At the broken line position, the document G is sent to the overwriting conveyance path 52. That is, when the document G which has been fed from the second feed portion 31 and whose images have been read by the image reading units 30*a* and 30*b* reaches the overwriting switching member 51, the document G is sent to the overwriting conveyance path 52 by switching the position of the overwriting switching member 51 to a position illustrated in FIG. 2, and is then conveyed to the duplex conveyance path 25. Then, the document G is sent to the registration roller pair 17 by the duplex conveyance roller pair 26, and thus overwriting printing on the document G can be performed.

Figure 3:
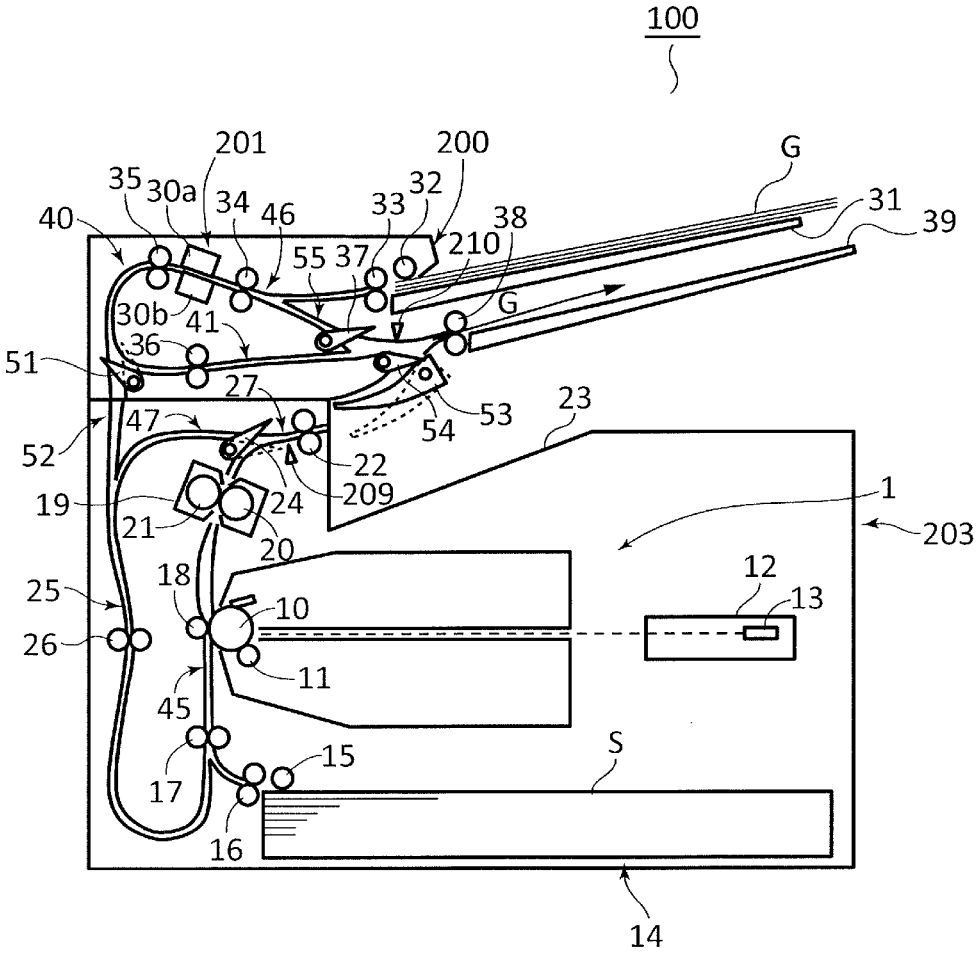
FIG. 3 illustrates an operation of the image forming apparatus according to the first exemplary embodiment.
Figure 4:
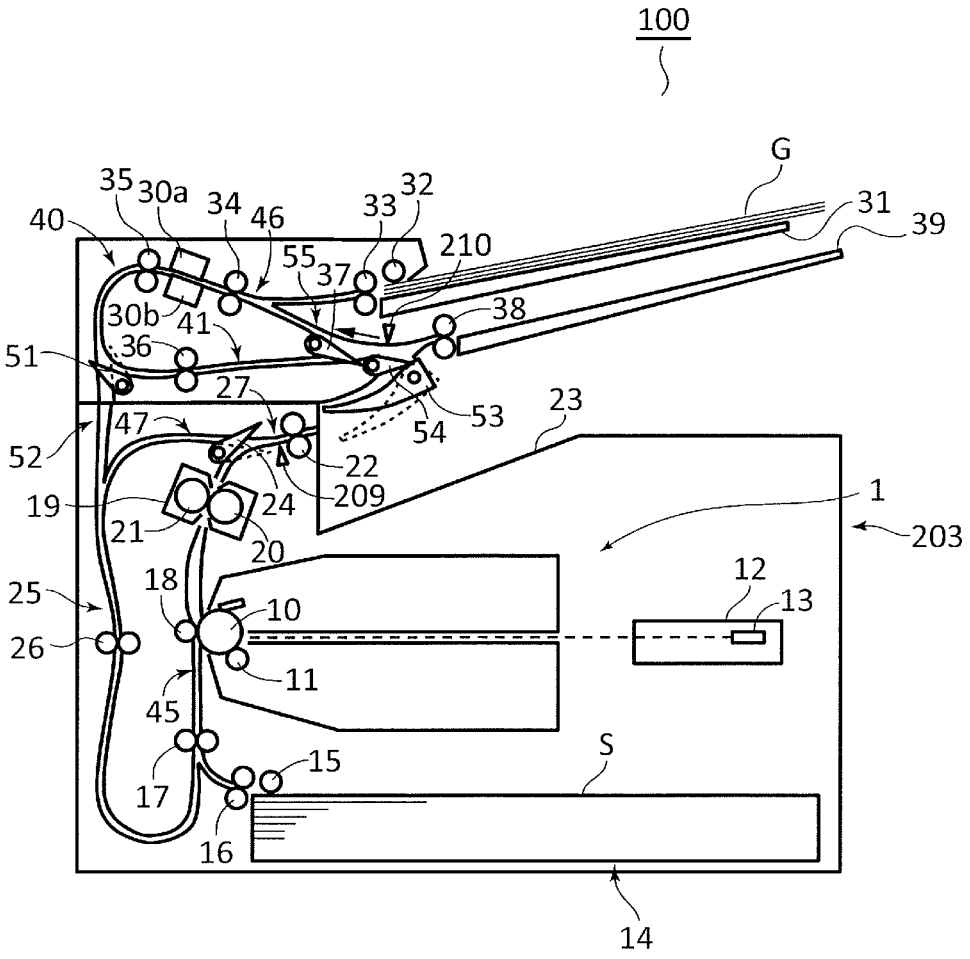
FIG. 4 illustrates an operation of the image forming apparatus according to the first exemplary embodiment.

Alternatively, the document G may be caused to temporarily wait inside the image reading section 201 before sending the document G to the image forming unit 1. In this case, when the document G that has been sent in from the second feed portion 31 through the reading guide path 46 and whose images have been read by the image reading units 30*a* and 30*b* reaches the overwriting switching member 51, the overwriting switching member 51 moves to the solid line position illustrated in FIG. 1. Thus, the document G is conveyed toward the document discharge roller pair 38. As illustrated in FIG. 3, the conveyance of the document G is temporarily stopped after the trailing end of the document G passes by the reading inversion switching member 37. The content of overwriting printing can be processed in this waiting time by analyzing the read image information of the document G. Then, the reading inversion switching member 37 is switched by the second solenoid SL2 illustrated in FIG. 8 or by the urging force applied in the clockwise direction as illustrated in FIG. 4, the rotation direction of the document discharge roller pair 38 is switched to the reverse rotation direction, and the document G is sent to the document inversion conveyance path 55 and then to the document conveyance path 40. After that, when the document G reaches the overwriting switching member 51 again, the document G is sent to the overwriting conveyance path 52 by switching the position of the overwriting switching member 51 to the position illustrated in FIG. 2, and thus overwriting printing can be performed on the document G.

Reading Process of Recording Medium

Next, a reading process of the recording medium S will be described with reference to FIGS. 1, 5, and 6.

In FIG. 1, the recording medium reading switching member 53 disposed downstream of the discharge roller pair 22 and above the first sheet discharged portion 23 can be switched between the solid line position to cause the recording medium S discharged by the discharge roller pair 22 to be discharged to the first sheet discharged portion 23 and the broken line position to cause the recording medium S to be sent to the document discharge roller pair 38.

Figure 5:
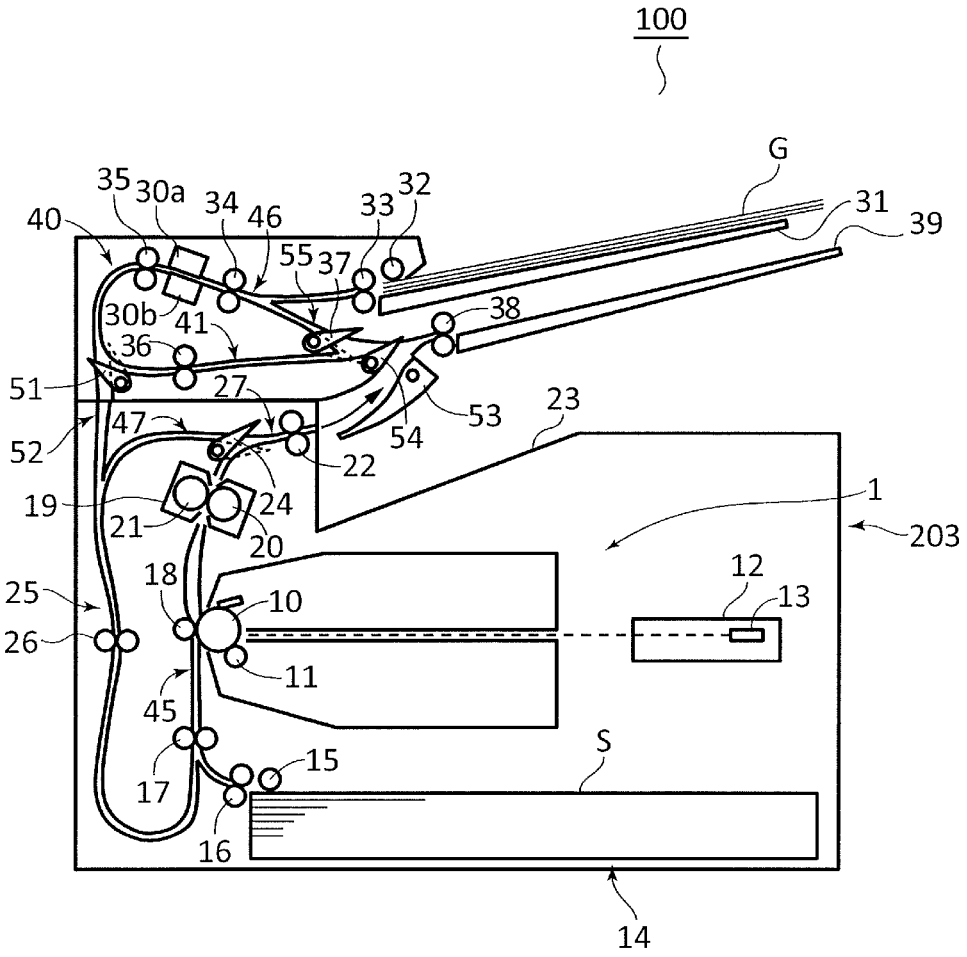
FIG. 5 illustrates an operation of the image forming apparatus according to the first exemplary embodiment.
Figure 6:
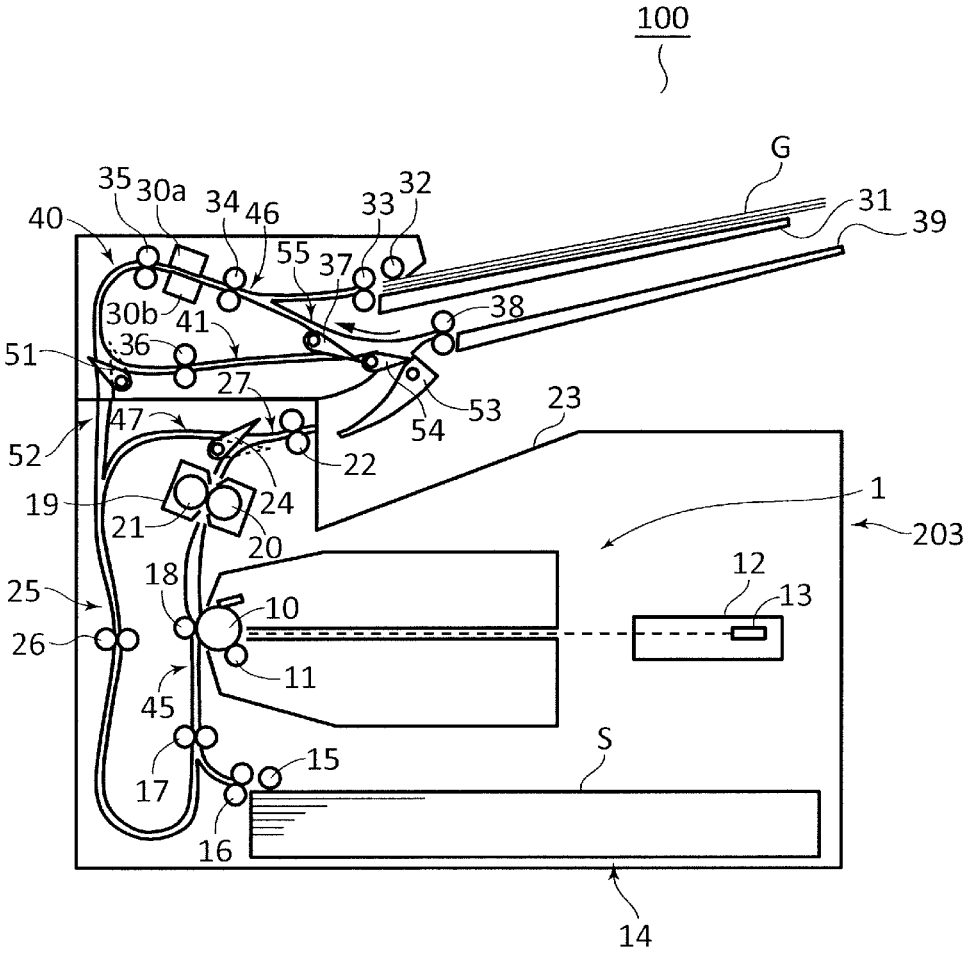
FIG. 6 illustrates an operation of the image forming apparatus according to the first exemplary embodiment.

When the recording medium reading switching member 53 is at a position illustrated in FIG. 5, the recording medium S on which an image has been formed is guided by the recording medium reading switching member 53 to the document conveyance path 40 via the merge switching member 54, and is conveyed by the document discharge roller pair 38. After the trailing end of the recording medium S passes by the merge switching member 54, the rotation direction of the document discharge roller pair 38 is switched to the reverse rotation direction with the reading inversion switching member 37 switched to the broken line position, and thus the following occurs. That is, as illustrated in FIG. 6, the recording medium S is sent to the image reading units 30*a* and 30*b* through the document inversion conveyance path 55 and the document conveyance path 40. In this way, the image on the recording medium S can be read. After that, the recording medium S is sent again to the document discharge roller pair 38 by the conveyance roller pair 36, and is discharged to the second sheet discharged portion 39 to be supported by the second sheet discharged portion 39.

A reading process of the recording medium S has been described above. Next, arrangement of components of the image forming apparatus 100 will be described below.

Figure 7:
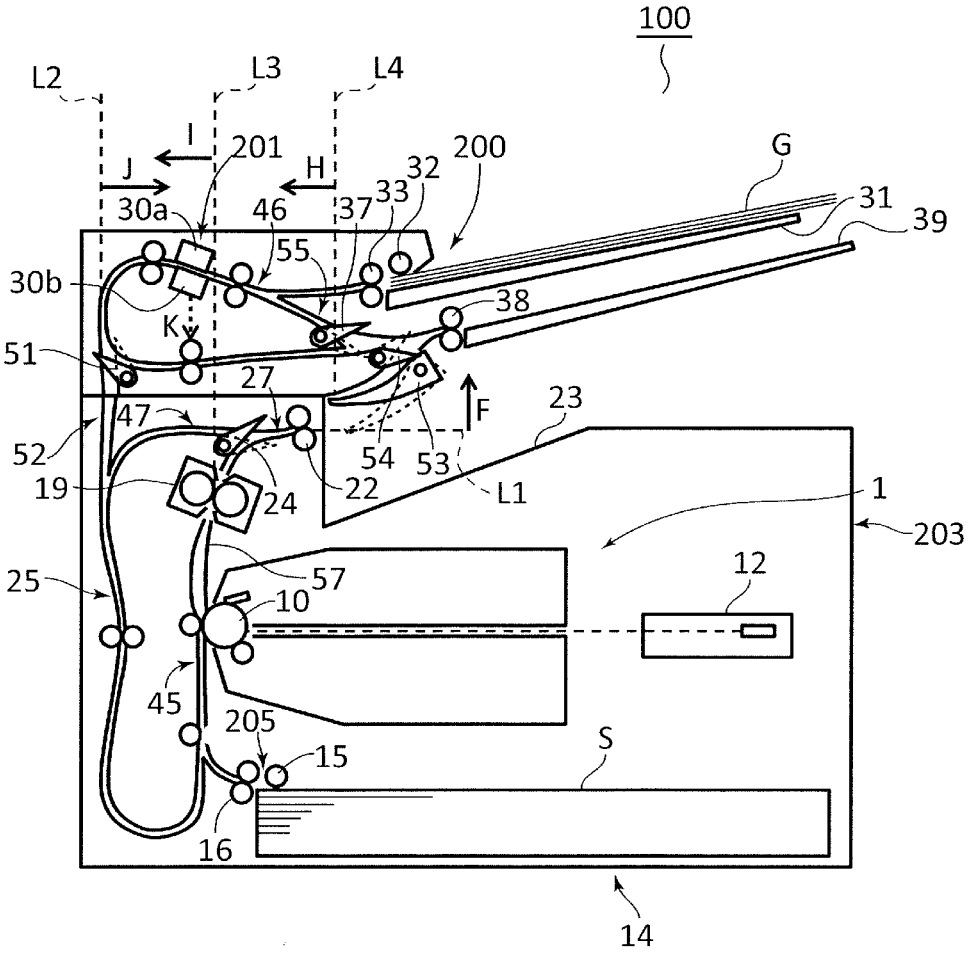
FIG. 7 is a schematic section view of the image forming apparatus according to the first exemplary embodiment.

Here, as illustrated in FIG. 7, the image reading units 30*a* and 30*b* are disposed above the discharge roller pair 22 disposed downstream of the discharge conveyance path 27 in the vertical direction. That is, the image reading units 30*a* and 30*b* are disposed at positions moved further in an arrow F direction from the position of a broken line L1. In addition, the image reading units 30*a* and 30*b* are disposed further on the inside of the apparatus than the overwriting switching member in a direction perpendicular to the vertical direction. That is, the image reading units 30*a* and 30*b* are disposed at positions moved further in an arrow J direction from the position of a broken line L2. Further, the image reading units 30*a* and 30*b* are disposed at positions closer to the overwriting conveyance path 52 than the recording medium reading switching member 53 constituting a merge conveyance path for reading the recording medium S. That is, the image reading units 30*a* and 30*b* are disposed at positions moved further in an arrow H direction from the position of a broken line L4.

For example, a case where the image reading units 30*a* and 30*b* are disposed below the discharge roller pair 22 is considered herein. In the case where the image reading units 30*a* and 30*b* are disposed in, for example, a space above the first sheet discharged portion 23, the amount of recording media supported on the first sheet discharged portion 23 is restricted, and accessibility to the supported recording media is lowered. In addition, in the case where the image reading units 30*a* and 30*b* are disposed on the left side surface of the apparatus in FIG. 7, that is, on the side where the overwriting switching member 51 is positioned, the image forming portion 203 becomes larger in the lateral direction, and thus the area for installation of the apparatus becomes larger.

In addition, a case where the image reading units 30*a* and 30*b* are disposed to the right of the discharge roller pair 22, that is, a merge conveyance path for reading the image on the recording medium S, is considered herein. In other words, the image reading units 30*a* and 30*b* are disposed at positions moved further in an opposite direction to the arrow H from the position of the broken line L4. In this case, not only the image forming portion 203 becomes larger rightward, but also the following may occur. That is, the trailing end of the recording medium S is still in the image forming unit 1 when the recording medium S reaches the image reading units 30*a* and 30*b*, and thus the conveyance speed during image reading may be affected by the conveyance speed in the image forming unit 1 and the precision of image reading may be degraded. Further, since the distance from the image reading units 30*a* and 30*b* to the overwriting conveyance path 52 becomes longer, the distance of conveyance for overwriting printing becomes longer, and thus the productivity is degraded.

Accordingly, the restriction of the supporting space of the first sheet discharged portion 23 and the lowering of the accessibility to the recording media on the first sheet discharged portion 23 can be suppressed by disposing the image reading units 30*a* and 30*b* as in the present exemplary embodiment. In addition, an apparatus which does not require a larger area for installation, in which image reading is not affected by the conveyance speed in the image forming unit 1, and which can perform image reading of a recording medium and overwriting on a document with a high productivity can be realized.

That is, since the image reading units 30*a* and 30*b* are disposed at least above the discharge roller pair 22, or the discharge conveyance path 27, in the vertical direction according to the present exemplary embodiment, the restriction of the supporting space on the first sheet discharged portion 23 and the lowering of the accessibility to the recording media on the first sheet discharged portion 23 can be suppressed. In addition, the image reading units 30*a* and 30*b* are disposed further on the inside of the apparatus than the overwriting switching member 51 in the direction perpendicular to the vertical direction. That is, the image reading units 30*a* and 30*b* are disposed at positions moved further in the arrow J direction from the position of the broken line L2. As a result of this, increase of the size of the image forming apparatus 100 when the image reading section 201 is provided can be suppressed. Further, the image reading units 30*a* and 30*b* are disposed at positions closer to the overwriting conveyance path 52 than the recording medium reading switching member 53, more preferably closer to the overwriting conveyance path 52 than the image formation conveyance path 45. That is, the image reading units 30*a* and 30*b* are disposed at positions moved further in the arrow H direction from the position of the broken line L4, and more preferably positions moved further in the arrow I direction from the position of the broken line L3. The image reading units 30*a* and 30*b* are disposed in a region between the upward extension line L3 of the image formation conveyance path 45 and the upward extension line L2 of the duplex conveyance path 25. This suppresses increase of the lateral size of the image forming portion 203 and thus increase of the area required for installation.

In addition, the trailing end of a sheet such as the document G is surely out of the image forming unit 1 when the sheet reaches the image reading units 30*a* and 30*b*, and thus the conveyance speed in the image forming unit 1 does not affect the conveyance speed during image reading and the precision of image reading is not degraded. Therefore, image reading of the document G and the recording medium S and overwriting on the document G can be performed with a high productivity. Further, the distance from the image reading units 30*a* and 30*b* to the overwriting conveyance path 52 can be set to be as short as possible, and thus the distance of conveyance for overwriting printing is shortened and the productivity can be improved.

In addition, in the present exemplary embodiment, the image reading units 30*a* and 30*b* described above are disposed above the image formation conveyance path 45 and the duplex conveyance path 25, and these conveyance paths 45 and 25 are disposed so as to extend parallel to a vertical line K extending from the image reading units 30*a* and 30*b*. This enables arranging the duplex conveyance path 25 and the image formation conveyance path 45, which connect the image reading units 30*a* and 30*b* and the image forming unit 1, such that the conveyance paths 25 and 45 are close to each other in the horizontal direction without being inclined. This is more effective for reduction of the area for installation of the image forming portion 203.

In the present exemplary embodiment, the overwriting conveyance path 52 serving as a third conveyance path that guides downward the document G or the recording medium S having passed between the image reading units 30*a* and 30*b* is connected to the duplex conveyance path 25. According to this, the document G whose images have been read by the image reading units 30*a* and 30*b* can be smoothly conveyed to the image forming unit 1, and overwriting can be performed on this document G. In addition, the document G or the recording medium S whose images have been read by the image reading units 30*a* and 30*b* can be securely conveyed to the duplex conveyance path 25 and subjected to image formation by the image forming unit 1 after passing through the duplex conveyance path 25.

Figure 9:
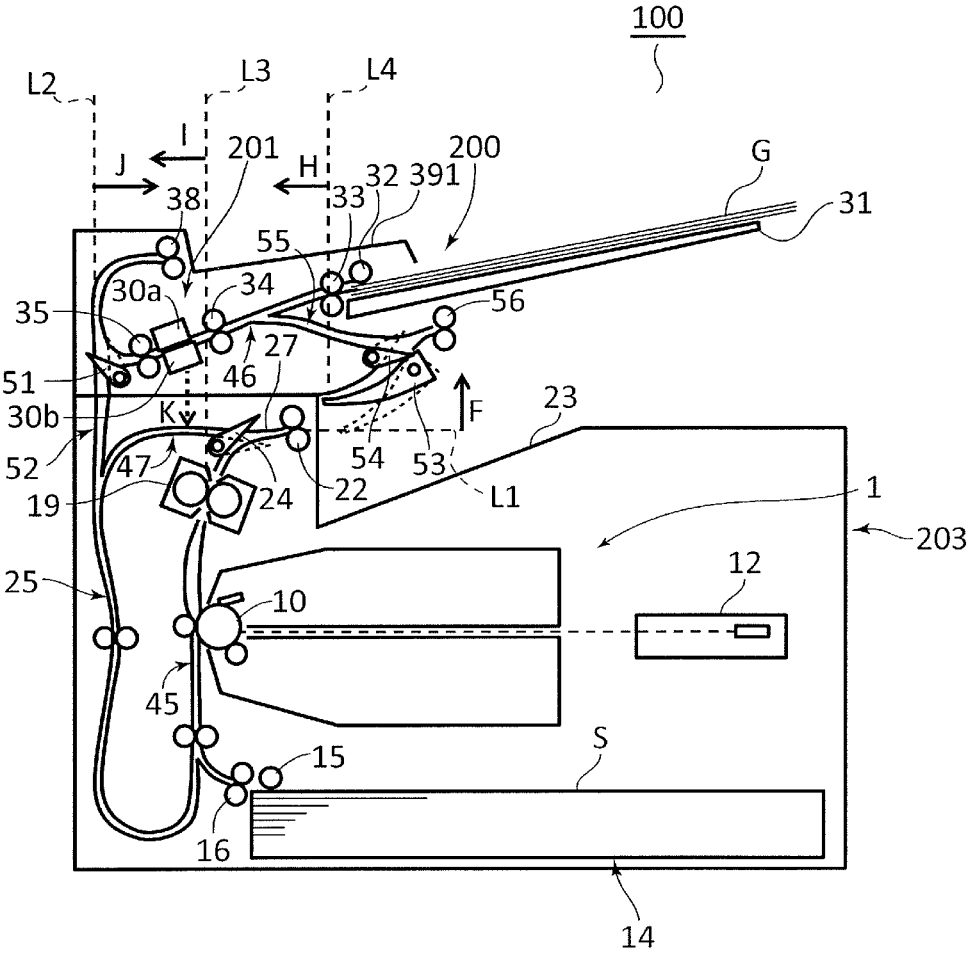
FIG. 9 is a schematic section view of the image forming apparatus according to the first exemplary embodiment.

Instead of the configuration in which the second sheet discharged portion 39 is disposed below the second feed portion 31 as described above, a configuration illustrated in FIG. 9 may be also employed. That is, a configuration in which a second sheet discharged portion 391 serving as a second supporting portion is disposed above the second feed portion 31, and an inversion roller 56 configured to invert and convey the recording medium S received from the image forming unit 1 to the image reading units 30*a* and 30*b* is provided may be employed. In the case where overwriting is to be performed on the document G in this configuration, the conveyance direction is switched by causing the document discharge roller pair 38 in the reverse rotation direction after the trailing end of the document G passes by the overwriting switching member 51. The document G may be conveyed to the image forming unit 1 by further guiding the document G to the overwriting conveyance path 52 by the overwriting switching member 51 switched to a broken line position illustrated in FIG. 9.

Second Exemplary Embodiment

Figure 10:
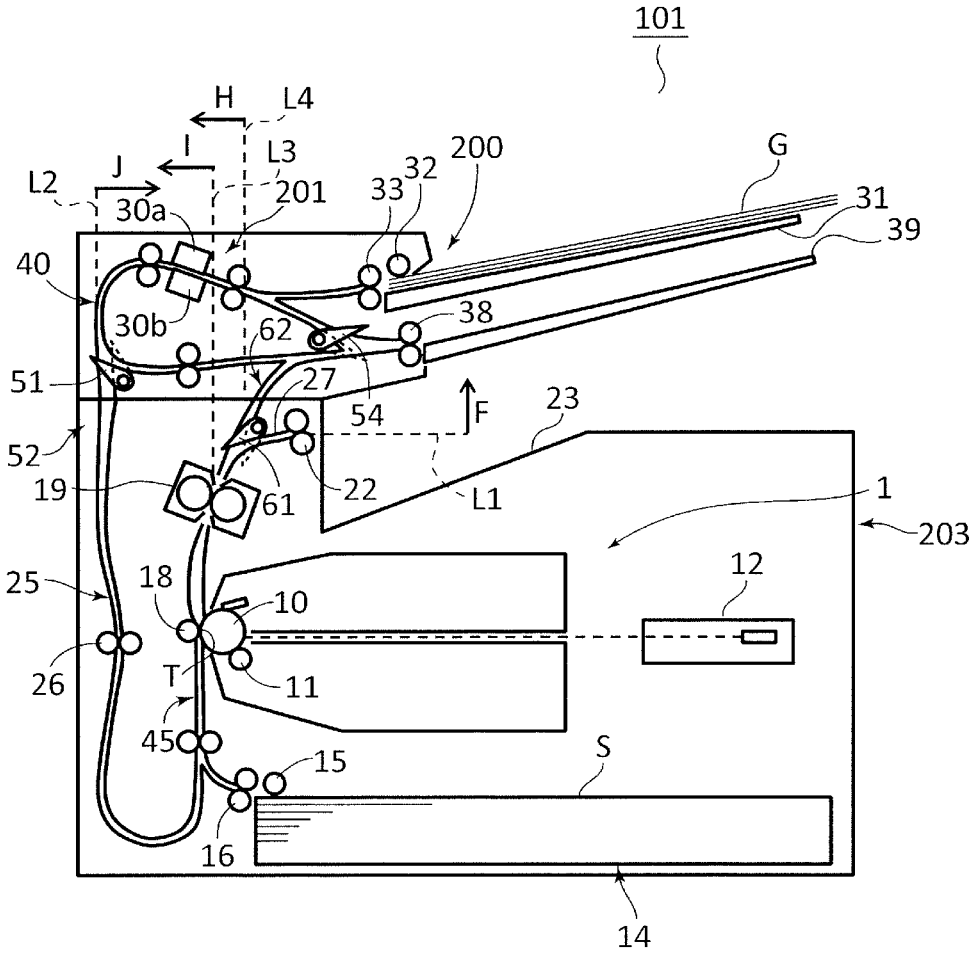
FIG. 10 is a schematic section view of an image forming apparatus according to a second exemplary embodiment.

Next, a second exemplary embodiment of the present invention will be described with reference to FIG. 10. FIG. 10 is a schematic section view of an image forming apparatus 101 equipped with an image reading apparatus according to the present exemplary embodiment. In the present exemplary embodiment, the same members as the first exemplary embodiment will be denoted with the same reference letters, and descriptions of members having the same configuration and the same function will be omitted.

In the present exemplary embodiment, a path in which the recording medium S is conveyed after passing through the fixing portion 19 branches to the discharge conveyance path 27 and a recording medium reading conveyance path 62 for sending the recording medium S to the image reading portion 200, and a recording medium reading switching member 61 is disposed at the branching point. In the case of performing image reading on the recording medium S, the recording medium S can be guided to the recording medium reading conveyance path 62 and thus conveyed to the image reading section 201 by moving the recording medium reading switching member 61 to a broken line position illustrated in FIG. 10 with an actuator that is not illustrated.

Also in this configuration, the image reading units 30*a* and 30*b* are disposed above the discharge conveyance path 27 and further on the inside of the apparatus than the overwriting conveyance path 52. That is, the image reading units 30*a* and 30*b* are disposed at positions moved further in the arrow F direction from the position of the broken line L1 and in the arrow J direction from the position of the broken line L2. In addition, the image reading units 30*a* and 30*b* are disposed at positions closer to the overwriting conveyance path 52 than the recording medium reading conveyance path 62, more preferably closer to the overwriting conveyance path 52 than the image formation conveyance path 45. That is, the image reading units 30*a* and 30*b* are disposed at positions moved further in the arrow H direction from the position of the broken line L4, and more preferably positions moved further in the arrow I direction from the position of the broken line L3. The image reading units 30*a* and 30*b* are disposed in a region between the upward extension line L3 of the image formation conveyance path 45 and the upward extension line L2 of the duplex conveyance path 25. According to this, an advantageous effect similar to the first exemplary embodiment can be achieved.

In the configuration illustrated in FIG. 10, the discharge roller pair 22 of the image forming unit 1 is not provided with a reverse rotation function, and a conveyance path for sending the recording medium S directly from the discharge roller pair 22 to the duplex conveyance path 25 is not provided either. In the case of performing duplex printing on the recording medium S in this configuration, the recording medium S is sent to the image reading section 201 by switching the recording medium reading switching member 61 to the broken line position. Then, printing on the second surface of the recording medium S may be performed by sending the recording medium S to the duplex conveyance path 25 through the document conveyance path 40 by using the reverse rotation function of the document discharge roller pair 38. Of course, the same applies to a configuration in which the recording medium reading conveyance path 62 of the present exemplary embodiment is provided in the image forming unit 1 including a conveyance path through which the recording medium S is conveyed to the duplex conveyance path 25 by rotating the discharge roller pair 22 in the reverse rotation direction as in the first exemplary embodiment.

Third Exemplary Embodiment

Figure 11:
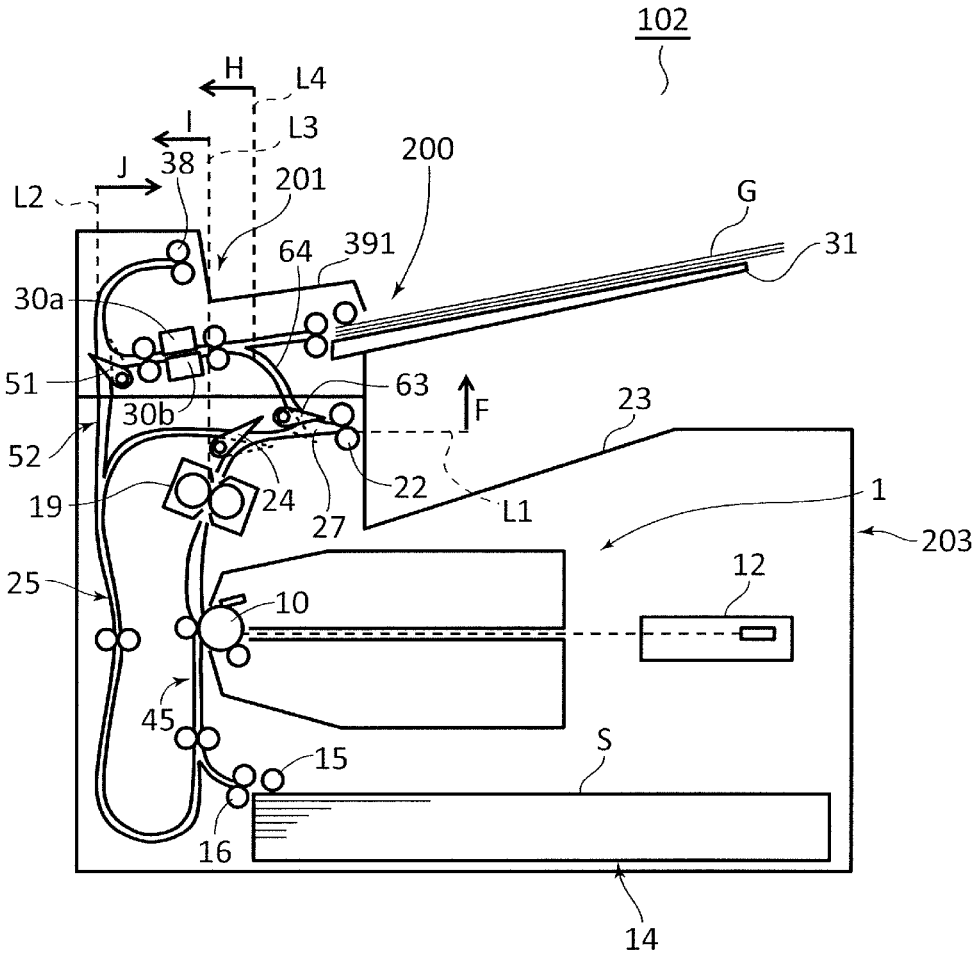
FIG. 11 is a schematic section view of an image forming apparatus according to a third exemplary embodiment.

Next, a third exemplary embodiment of the present invention will be described with reference to FIG. 11. FIG. 11 is a schematic section view of an image forming apparatus 102 according to the present exemplary embodiment. In the present exemplary embodiment, the same members as the first exemplary embodiment will be denoted with the same reference letters, and descriptions of members having the same configuration and the same function will be omitted.

In the present exemplary embodiment, a recording medium reading conveyance path 64 for sending the recording medium S to the image forming unit 1 after switching the conveyance direction to the reverse direction by rotating the discharge roller pair 22 in the reverse rotation direction is provided so as to branch off from the discharge conveyance path 27, and a recording medium reading switching member 63 is disposed at the branching point. In the case of performing image reading of the recording medium S, the recording medium S can be guided to the recording medium reading conveyance path 64 and thus conveyed to the image reading section 201 by moving the recording medium reading switching member 63 to a broken line position illustrated in FIG. 11 with an actuator that is not illustrated.

Also in the configuration described above, the image reading units 30*a* and 30*b* are disposed above the discharge conveyance path 27 and further on the inside of the apparatus than the overwriting conveyance path 52. That is, the image reading units 30*a* and 30*b* are disposed at positions moved further in the arrow F direction from the position of the broken line L1 and in the arrow J direction from the position of the broken line L2. In addition, the image reading units 30*a* and 30*b* are disposed at positions closer to the overwriting conveyance path 52 than the recording medium reading conveyance path 64, more preferably closer to the overwriting conveyance path 52 than the image formation conveyance path 45. That is, the image reading units 30*a* and 30*b* are disposed at positions moved further in the arrow H direction from the position of the broken line L4, and more preferably positions moved further in the arrow I direction from the position of the broken line L3. The image reading units 30*a* and 30*b* are disposed in a region between the upward extension line L3 of the image formation conveyance path 45 and the upward extension line L2 of the duplex conveyance path 25. According to this, an advantageous effect similar to the first exemplary embodiment can be achieved.

In the first to third exemplary embodiments described above, examples using the image forming apparatuses 100 to 102 employing an electrophotographic system have been described. Alternatively, instead of this, the present invention may be applied to, for example, an image forming apparatus employing an inkjet system in which an image is formed on a sheet by ejecting liquid ink from nozzles.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-085611, filed Apr. 21, 2016, which is hereby incorporated by reference wherein in its entirety.

What is claimed is:

1. An image forming apparatus comprising:

an image forming unit configured to form an image on a sheet;

a first discharging portion configured to discharge the sheet on which the image has been formed to an outside of the image forming apparatus;

a first supporting portion configured to support the sheet discharged by the first discharging portion;

an image reading portion configured to read the image formed on the sheet;

a first switching portion configured to switch between a first position to cause the sheet discharged by the first discharging portion to be conveyed to the first supporting portion and a second position to cause the sheet to be conveyed toward the image reading portion configured to read the image;

a second discharging portion configured to discharge the sheet whose image has been read by the image reading portion to the outside of the image forming apparatus;

a second supporting portion configured to support the sheet discharged by the second discharging portion; and a second switching portion configured to switch between a third position to cause the sheet whose image has been read by the image reading portion to be conveyed toward the second discharging portion and a fourth position to cause the sheet to be conveyed toward the image forming unit, wherein the image reading portion is disposed above the first discharging portion in a vertical direction.

2. The image forming apparatus according to claim 1, further comprising:

a first conveyance path through which the sheet is conveyed to the image forming unit; and a second conveyance path through which the sheet whose image has been read by the image reading portion is conveyed toward the image forming unit, wherein the image reading portion is disposed in a region between an upward extension line of the first conveyance path and an upward extension line of the second conveyance path.

3. The image forming apparatus according to claim 2, further comprising:

a sheet supplying portion configured to supply the sheet to the image reading portion;

a reading guide path in which the image reading portion is disposed and which is configured to guide the sheet supplied from the sheet supplying portion to the image reading portion; and a sheet conveyance path configured to guide the sheet from the image reading portion to the second supporting portion, wherein the second supporting portion is disposed below the image reading portion, and wherein the sheet conveyance path is connected to the second conveyance path and configured to guide the sheet from the image reading portion to the second supporting portion below the image reading portion.

4. The image forming apparatus according to claim 2, further comprising:

a sheet supplying portion configured to supply the sheet to the image reading portion;

a reading guide path in which the image reading portion is disposed and which is configured to guide the sheet supplied from the sheet supplying portion to the image reading portion; and a sheet conveyance path configured to guide the sheet from the image reading portion to the second supporting portion, wherein the second supporting portion is disposed above the image reading portion, and wherein the sheet conveyance path is connected to the second conveyance path and configured to guide the sheet from the image reading portion to the second supporting portion above the image reading portion.

5. The image forming apparatus according to claim 2, further comprising a third conveyance path configured to guide downward the sheet that has passed through the image reading portion, wherein the third conveyance path is connected to the second conveyance path.

6. The image forming apparatus according to claim 5, further comprising a re-conveyance path through which the sheet inverted and conveyed by the first discharging portion is conveyed toward the image forming unit again, wherein the third conveyance path is connected to the second conveyance path and the re-conveyance path.

7. An image forming apparatus comprising:

an image forming unit configured to form an image on a sheet;

a first discharging portion configured to discharge the sheet on which the image has been formed to an outside of the image forming apparatus;

a first supporting portion configured to support the sheet discharged by the first discharging portion;

an image reading portion configured to read the image formed on the sheet;

a first switching portion configured to switch between a first position to cause the sheet on which the image has been formed by the image forming unit to be conveyed toward the first discharging portion and a second position to cause the sheet to be conveyed toward the image reading portion configured to read the image;

a second discharging portion configured to discharge the sheet whose image has been read by the image reading portion to the outside of the image forming apparatus;

a second supporting portion configured to support the sheet discharged by the second discharging portion; and a second switching portion configured to switch between a third position to cause the sheet whose image has been read by the image reading portion to be conveyed toward the second discharging portion and a fourth position to cause the sheet to be conveyed toward the image forming unit, wherein the image reading portion is disposed above the first discharging portion in a vertical direction.

8. An image forming apparatus comprising:

an image forming unit configured to form an image on a sheet;

a first discharging portion configured to discharge the sheet on which the image has been formed to an outside of the image forming apparatus or invert and convey the sheet back into the image forming apparatus;

a first supporting portion configured to support the sheet discharged by the first discharging portion;

an image reading portion configured to read the image formed on the sheet;

a first switching portion configured to switch between a first position to cause the sheet inverted by the first discharging portion to be conveyed toward the image forming unit and a second position to cause the sheet to be conveyed toward the image reading portion configured to read the image;

a second discharging portion configured to discharge the sheet whose image has been read by the image reading portion to the outside of the image forming apparatus or invert and convey the sheet back into the image forming apparatus;

a second supporting portion configured to support the sheet discharged by the second discharging portion; and a second switching portion configured to switch between a third position to cause the sheet inverted by the second discharging portion to be conveyed toward the image forming unit and a fourth position to cause the sheet to be conveyed toward the image reading portion, wherein the image reading portion is disposed above the first discharging portion in a vertical direction.

9. The image forming apparatus according to claim 1, wherein the image reading portion is disposed further on a side of the first switching portion than an opposite side with respect to the second switching portion in a direction perpendicular to the vertical direction.

10. The image forming apparatus according to claim 7, wherein the image reading portion is disposed further on a side of the first switching portion than an opposite side with respect to the second switching portion in a direction perpendicular to the vertical direction.

11. The image forming apparatus according to claim 8, wherein the image reading portion is disposed further on a side of the first switching portion than an opposite side with respect to the second switching portion in a direction perpendicular to the vertical direction.

* * * * *